US005845449A

United States Patent [19]

Vaughan et al.

[11] Patent Number: 5,845,449

[45] **Date of Patent: *Dec. 8, 1998**

[54] CONCRETE FORMING SYSTEM WITH BRACE TIES

[75] Inventors: Jamieson R. Vaughan, Omaha; Jay D. Williamson, Papillion, both of Nebr.; Kenneth M. Blom, Kansas City; James D. Stokes, Drexel, both of Mo.; Dewayne L. Bollinger, Overland Park, Kans.

[73] Assignee: I.S.M., Inc., Paola, Kans.

[ * ] Notice: The term of this patent shall not extend beyond the expiration date of Pat. No. 5,709,060.

[21] Appl. No.: 754,853

[22] Filed: Nov. 22, 1996

Related U.S. Application Data

[63] Continuation of Ser. No. 334,146, Nov. 4, 1994, abandoned.

[51] Int. Cl.[6] ..... E04B 2/30

[52] U.S. Cl. ..... 52/565; 52/105; 52/309.11; 52/309.12; 52/426; 52/568; 52/592.1; 52/592.6; 52/604; 52/693

[58] Field of Search ..... 52/426, 427, 428, 52/565, 568, 712, 105, 309.11, 309.12, 592.1, 592.6, 604, 605, 607, 657, 693

[56] References Cited

U.S. PATENT DOCUMENTS

| | | |
|---|---|---|
| 880,820 | 3/1908 | Pierson . |
| 1,871,318 | 8/1932 | Greenwood . |
| 3,778,020 | 12/1973 | Burrows et al. . |
| 3,788,020 | 1/1974 | Gregori . |
| 3,872,636 | 3/1975 | Nicosia . |
| 3,922,828 | 12/1975 | Patton . |
| 3,979,867 | 9/1976 | Sowinski . |
| 4,223,501 | 9/1980 | DeLozier . |
| 4,516,372 | 5/1985 | Grutsch . |
| 4,698,947 | 10/1987 | McKay . |
| 4,706,429 | 11/1987 | Young . |
| 4,730,422 | 3/1988 | Young . |
| 4,731,968 | 3/1988 | Obino . |
| 4,750,308 | 6/1988 | McKay . |
| 4,765,109 | 8/1988 | Boeshart . |
| 4,879,855 | 11/1989 | Berrenberg . |
| 4,884,382 | 12/1989 | Horobin . |
| 4,889,310 | 12/1989 | Boeshart . |
| 4,916,879 | 4/1990 | Boeshart ..... 52/426 |
| 5,065,561 | 11/1991 | Mason . |

*Primary Examiner*—Christopher Kent
*Attorney, Agent, or Firm*—Chase & Yakimo

[57] ABSTRACT

A form tie for joining the sidewalls of a polymeric concrete form comprises a pair of end trusses with an intermediate web truss. Each end truss comprises a pair of vertical struts with interior and exterior pairs of horizontal struts extending therebetween. The width of the web truss corresponds to the desired lateral distance between the interior surfaces of the form sidewalls. Upper and lower rectangular trusses and an intermediate truss are formed within each truss and rigidified by diagonal struts. The exterior struts of each end truss are embedded in the polymeric form of the sidewalls during the molding process with the interior struts of each end truss sealing the mold openings to prevent expansion of the foam from the mold. The interior struts are coplanar with the form sidewalls and serve as a visual gauge that the form and tie have been properly positioned. End ties having a height of one-half of the form sidewall are extended between the sidewalls at the ends of each form. The end ties of adjacent forms are vertically offset to enhance concrete flow therebetween. The exterior struts of the tie have a greater bearing surface than the interior struts so as to firmly anchor the end trusses within the foam sidewalls. During transport and use the trusses resist the presence of compression, tension, twisting and other forces acting on the forms so as to maintain the desired spatial relationship between the forms. A seat for horizontal rebar is found with each form tie.

13 Claims, 8 Drawing Sheets

CONCRETE FORMING SYSTEM WITH BRACE TIES

This application is a continuation of application Ser. No. 08/334,146, filed Nov. 4, 1994, now abandoned.

BACKGROUND OF THE INVENTION

This invention relates to a concrete forming system and, more particularly, to novel form ties for maintaining the sidewalls of a concrete form in desired longitudinal, vertical and laterally spaced-apart relationships.

Concrete forms made of a polymeric foam material are known. One such form is shown in U.S. Pat. No. 3,788,020, issued on Jan. 29, 1974. This patent discloses a concrete form with a pair of sidewalls, end walls and intermediate partition walls. A plurality of these forms are connected to present vertical cavities for pouring concrete therein to form a plurality of vertical concrete columns or piers. These vertical columns are connected by a horizontal concrete beam formed by filling a channel with concrete, the channel presented upon placing one row of concrete forms atop another.

One problem with these concrete forms is that the sidewalls must be immobilized so as to resist pressures on the walls during transport and, more importantly, during concrete pouring and curing. If not, the form sidewalls may shift in lateral and/or vertical and/or longitudinal directions. Such displacements make it difficult to easily connect the forms. Also, the forms may separate along the joints respectively presented along the zones of connection between longitudinally and vertically adjacent forms. If not sufficiently braced the concrete can cause these joints to separate. The industry refers to such separations as "blow outs".

Accordingly, various devices in the forms of braces and permanent tension members have been proposed so as to maintain the sidewalls in place to preclude such shifting and/or "blow outs" during concrete pouring and subsequent curing. However, such devices have been relatively complex in construction requiring the sidewalls to have special configurations so as to receive the braces and/or ties.

In response thereto we have invented novel ties for reinforcing concrete forms which effectively interface with the form sidewalls so as to maintain the walls in a desired spatial relationship during transport as well as concrete pouring and curing.

Each form tie generally comprises a pair of end trusses with an intermediate web truss spanning the form sidewalls. The trusses are formed by a pair of vertical end struts with a pair of horizontal struts spanning the upper and lower ends of the vertical struts. A second pair of interior vertical struts and horizontal struts are spaced from the perimetrical struts to form a plurality of secondary rectangular trusses. First and second diagonal struts rigidify the trusses. The end trusses are embedded in the sidewalls of the forms during the molding process with the intermediate web truss spanning the facing interior surfaces of the sidewalls. The ties preclude lateral, vertical and longitudinal shifting of the sidewalls during transport and use. The ties utilized adjacent the ends of the form sidewalls are halved so as to not interfere with concrete flow between longitudinally adjacent concrete forms.

It is therefore a general object of this invention to provide a novel concrete form tie for use in a concrete forming system.

A further object of this invention is to provide a concrete form tie, as aforesaid, which is incorporated in the concrete form during the blow molding thereof.

Another general object of this invention is to provide a concrete form tie, as aforesaid, which resists loads that impart tension, compression, bending, twisting and lateral stresses acting thereon.

Still a further object of this invention is to provide a concrete form tie, as aforesaid, which diminishes the lateral, vertical and longitudinal displacement of adjacent sidewalls of a concrete form during transport and use.

A still more particular object of this invention is to provide a concrete form tie, as aforesaid, which presents a plurality of reinforcing trusses within and between the sidewalls of a concrete form.

A further particular object of this invention is to provide a concrete form tie with trusses, as aforesaid, which are reinforced by diagonal struts extending therethrough.

Another particular object of this invention is to provide a concrete form tie, as aforesaid, which enhances on-site assembly of the concrete forms.

A further object of this invention is to provide a concrete tie, as aforesaid, which does not interfere with concrete flow through the form sidewalls and between adjacent forms.

Another particular object of this invention is to provide a concrete tie, as aforesaid, which effectively precludes seepage of the polymeric foam from the form mold during the molding process.

A further particular object of this invention is to provide a concrete tie, as aforesaid, which presents a pair of end trusses anchored in each sidewall of a polymeric foam with a web truss defining the lateral distance between the form sidewalls.

Still a more particular object of this invention is to provide a concrete tie with end trusses, as aforesaid, the latter having a vertical strut coplanar with the interior surface of a form sidewall to indicate a proper distance between the form sidewalls.

Another particular object of this invention is to provide a concrete tie with end trusses, as aforesaid, the latter having a vertical strut anchoring the end truss in a form sidewall.

Other objects and advantages of this invention will become apparent from the following description taken in connection with the accompanying drawings, wherein is set forth by way of illustration and example, now preferred embodiments of this invention.

DESCRIPTION OF THE PREFERRED EMBODIMENT

Figure 1:
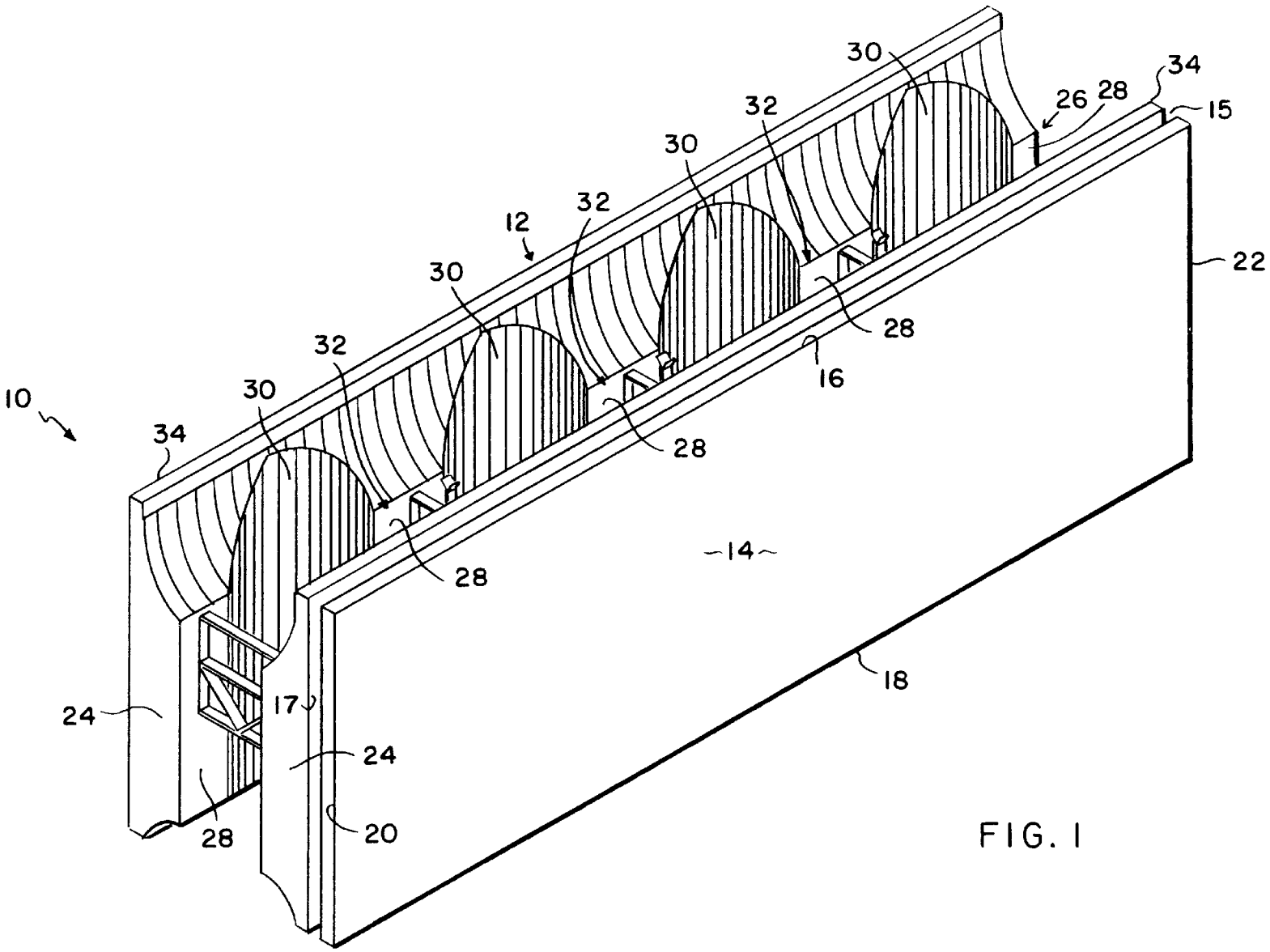
FIG. 1 is a perspective view of a plurality of concrete form ties spanning first and second sidewalls of a concrete form.

Turning more particularly to the drawings, FIG. 1 shows one type of concrete form 10 as generally comprising a pair of sidewalls 12, 14. Each sidewall has upper 16 and lower 18 longitudinal edges as well as a pair of opposed vertical edges 20, 22. The form 10 further includes a pair of longitudinally displaced end walls 24, 26 with intermediate longitudinally spaced-apart partition walls 28. The sidewalls 12, 14, end walls 24, 26 and partition walls 28 cooperate to form a plurality of vertical cavities 30 and a vertical slot 32 between the facing surfaces of the end walls 24, 26 and partition walls 28. Slot 32 longitudinally spans the length of the form 10 and connects the cavities 30. Each form 10 has tongues 34 along the respective upper 16 edges which mate with complementary grooves 36 located along the lower edges of an overlying form 10.

At one end the end walls 24 extend beyond the sidewalls. At the opposed end the sidewalls 12, 14 extend beyond the end wall 26. Thus, lap joint surfaces are formed. The sidewall extensions 15 at one end of one form overlap the end wall extensions 17 of an adjacent form when joined in a longitudinally adjacent relationship. Accordingly, the forms 10 may be connected in longitudinally extending courses and stacked one atop the other.

Although not shown it is understood that the first course of forms are positioned atop a footing and held in place by various materials such as plastic roof cement. It is understood that other types of connection of the first row of forms to the footing may be utilized such as placing the forms in a wet footing and allowing the footing to subsequently dry. Upon reaching a desired height of the form courses wet concrete is poured between the form sidewalls 12, 14. (It is understood that the forms are staggered among rows so as to preclude formation of a continuous vertical joint among the form rows.) The poured concrete fills the vertical cavities 30 and longitudinally extending vertical slot 32 of each form. Also, upon stacking a second course of forms atop the first a horizontal channel is formed which spans the upper and lower forms. The poured concrete will fill the channel of the form. Thus, a concrete wall within slot 32, concrete piers within cavities 30 and a horizontal beam of concrete within the channel is presented. The forms 10 are left in place for insulating the resulting concrete wall. Wall clips 900 are shown for attaching exterior siding thereto. Such clips 900 are the subject of a separate patent application.

It is known that the courses of the forms may be selectably configured so as to present walls of various configurations. Also, door frames, window frames, bucks, bulkheads, and the like may interrupt the courses of forms so as to provide openings for insertion of doors, windows and the like therein while precluding spillage of poured concrete from the forms.

During the pouring of the concrete a hydraulic concrete load acts on the sidewalls 12, 14 of each form 10 as well as on any structure spanning such sidewalls 12, 14. The load urges the sidewalls 12, 14 from their proper vertical, lateral and longitudinal spatial relationships. Also during form transport to the job site, the sidewalls 12, 14 may be displaced due to the weight of other forms stacked thereon. In some cases the distance between the sidewalls 12, 14 may vary. Accordingly, problems will arise when attempting to longitudinally and vertically connect forms as the mating lap joint surfaces and/or tongue/groove elements will not be properly aligned.

Figure 4:
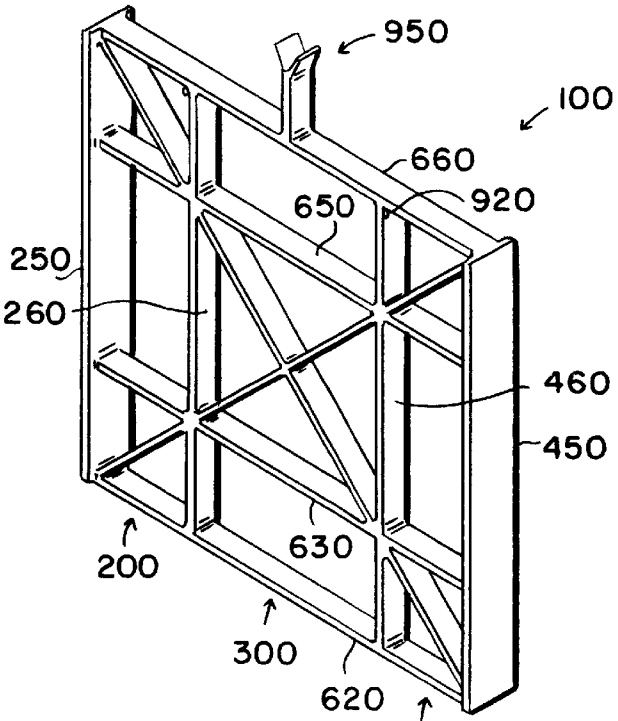
FIG. 4 is a perspective view of the form tie of FIG. 3.
Figure 3:
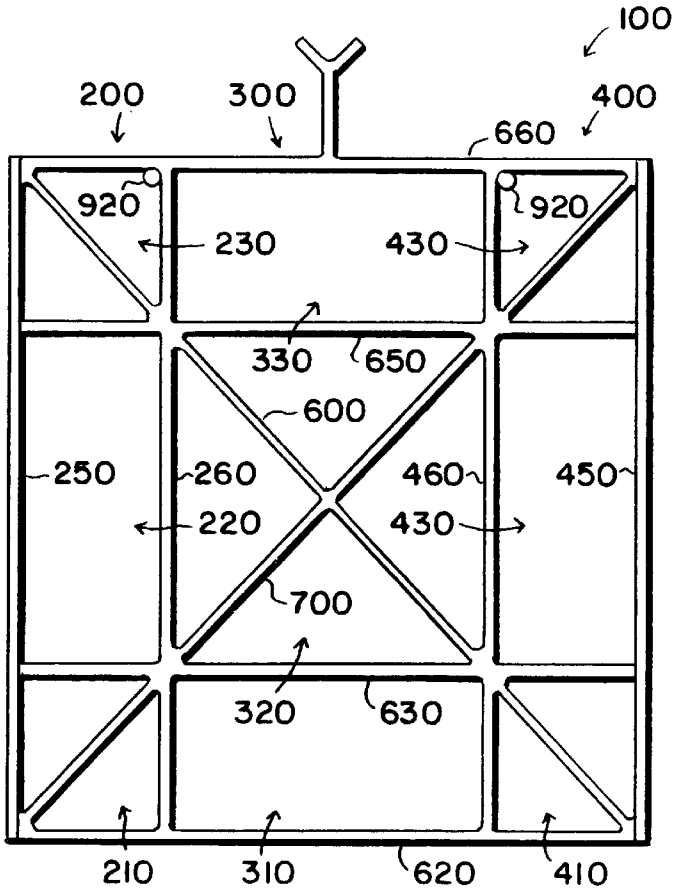
FIG. 3 is a plan view of the concrete form tie shown in FIGS. 1 and 2 on an enlarged scale.

As best shown in FIGS. 3 and 4 each tie 100 presents an overall square configuration. The tie comprises first 200 and second 400 laterally spaced-apart end trusses with an intermediate web truss 300 therebetween. Each end truss 200, 400 generally comprises a first vertical strut 250, 450 with a second vertical strut 260, 460 laterally displaced therefrom. A pair of horizontal struts 620, 660 extend between the lower and upper ends of the end struts 250, 450 and intermediate vertical struts 260, 460. The combination of these horizontal and vertical struts presents the primary rectangular configuration to the end trusses 200, 400 and intermediate web truss 300.

Vertically displaced from the respective horizontal struts 620, 660 are a second pair of horizontal struts 630, 650. These struts 630, 650 cooperate with the above-described struts to present upper, lower and intermediate trusses within each primary truss 200, 300, 400. The respective end trusses 200, 400 thus have lower and upper rectangular trusses 210, 230, 410, 430 with intermediate trusses 220, 420. The web truss 300 presents lower and upper trusses 310, 330 with intermediate truss 320.

A pair of diagonal struts 600, 700, extend between the primary opposed corners of the tie 100 to provide overall rigidity thereto. As seen in FIGS. 3 and 4, the diagonal struts 600, 700 also extend through the lower 210, 410 and upper 230, 430 sections of the end trusses 200, 400 and the central section 320 of the web truss 300.

Two bipartite molds are used for forming the sidewalls 12, 14 of the polymeric concrete form 10. Polystyrene beads are blown into the respective sidewall molds at a first temperature with the beads expanding upon cooling so as to fill the mold. Upon the beads being reheated at an elevated temperature, a second expansion occurs so that the foam fills the mold. Upon removal of the mold the sidewalls are presented.

One problem which has arisen with the use of form ties is that the sidewall molds must have openings therein to allow for insertion of the ends of the tie in each mold and extension of the tie between the sidewall molds. In turn, the expanding foam may escape from these mold openings. Such a leakage/seepage of the foam from the mold may impair form integrity and lead to undesirable ruptures, cracks, etc. in the forms. Such defects may not be visibly apparent until the form sidewalls are subjected to the hydraulic loads presented by the poured concrete between the form sidewalls 12, 14.

Figure 2:
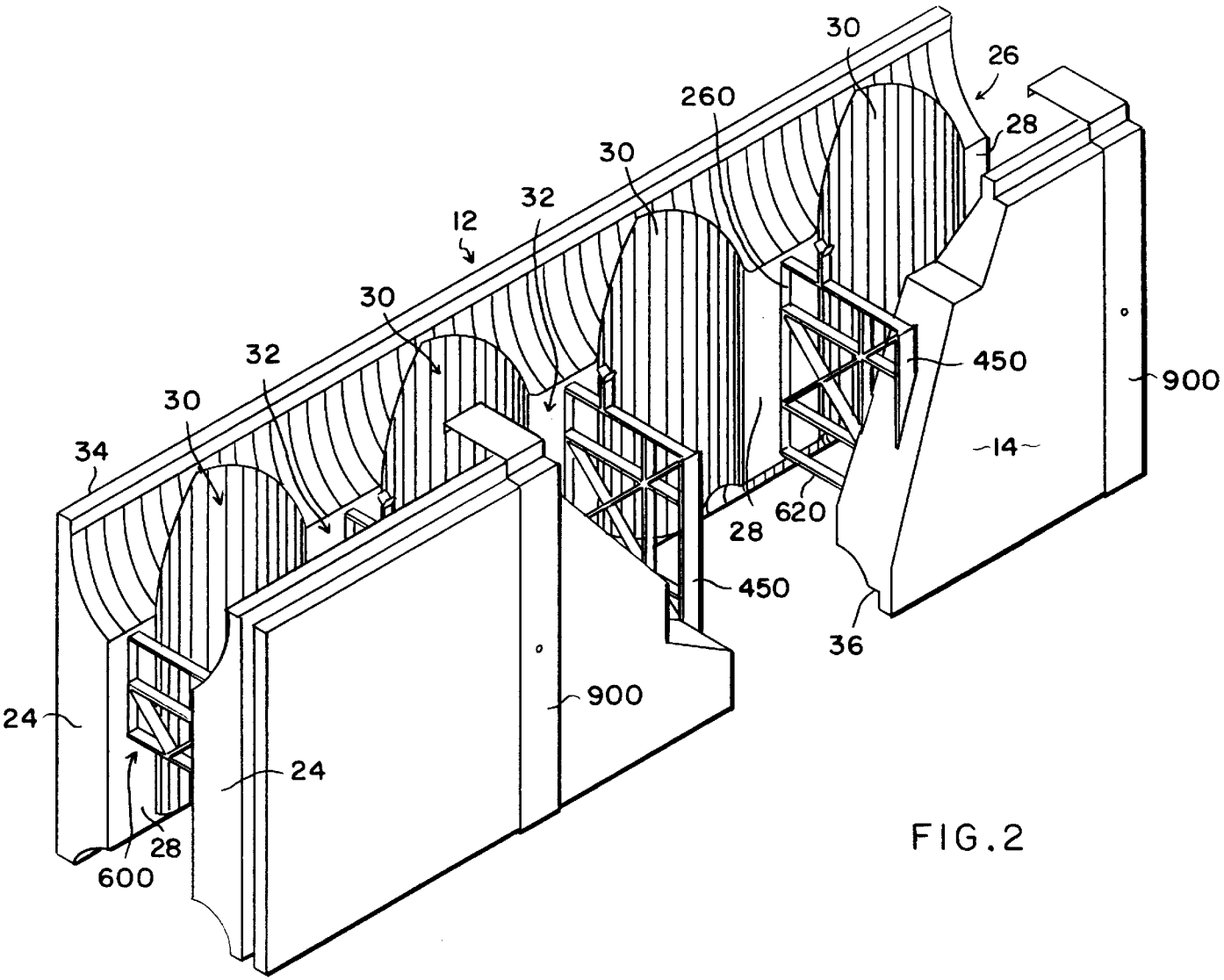
FIG. 2 is a perspective view of the form of FIG. 1 with a portion of one sidewall of the form broken away to show the concrete tie embedded within the sidewall of the form.
Figure 12:
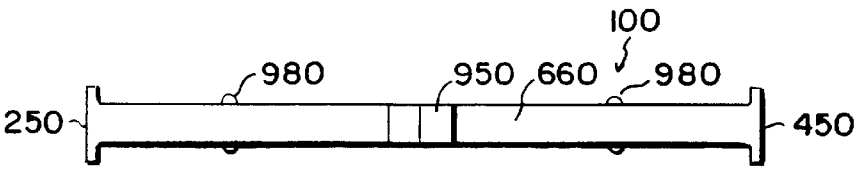
FIG. 12 is a top view of the tie of FIG. 3.

In response to such a problem the interior vertical struts 260, 460 are configured to seal the mold openings. (Also shown are a plurality of nipples 980 which act as guides to assist the mold operator in aligning the tie 100 within the mold openings.) Thus, the struts 260, 460 preclude escape of the expanding polystyrene foam from the mold. The results of a proper sealing are as shown in FIGS. 1 and 2 as the opposed faces of these struts 260, 460 are not covered by foam. Also, the distance between these interior struts 260, 460 define the width of the intermediate web 300 and thus the resulting lateral displacement between the sidewalls 12, 14. Accordingly, the coplanar relationship of the opposed, interior faces of the strut 260, 460 with the interior faces of the partition walls 28 present a visual gauge of a common lateral displacement between the sidewalls 12, 14 of all forms. If not, i.e. the strut extends below or beyond the sidewalls, the form 10 sidewalls 12, 14 have an undesirable lateral displacement and should be discarded prior to use.

Thus, the intermediate web 300 fixes and maintains a desired lateral distance between the facing vertical surfaces of the partition sidewalls 28 of the form 10. This common lateral modularity assures the builder that the stacked forms 10 will present even exterior surfaces as presented by the exterior surfaces.

As best shown in FIG. 2, the end trusses 200, 400 are embedded in the sidewalls 12, 14 of the form. As such the end trusses 250, 450 are centrally embedded within the respective sidewall 12, 14 to resist any forces acting thereon which may disrupt the monolithic structure of the sidewall. The web 300 spans the sidewalls 12, 14 with the intermediate truss 320 being rigidified by diagonals 600, 700. As such, a plurality of trusses 310, 320, 330 extend between the sidewalls so as to maintain the distance therebetween in the presence of hydraulic concrete loads. It is noted that the struts of the trusses are so arranged so as to present a minimal amount of surface to a longitudinal concrete flow through the form 10.

Figure 6:
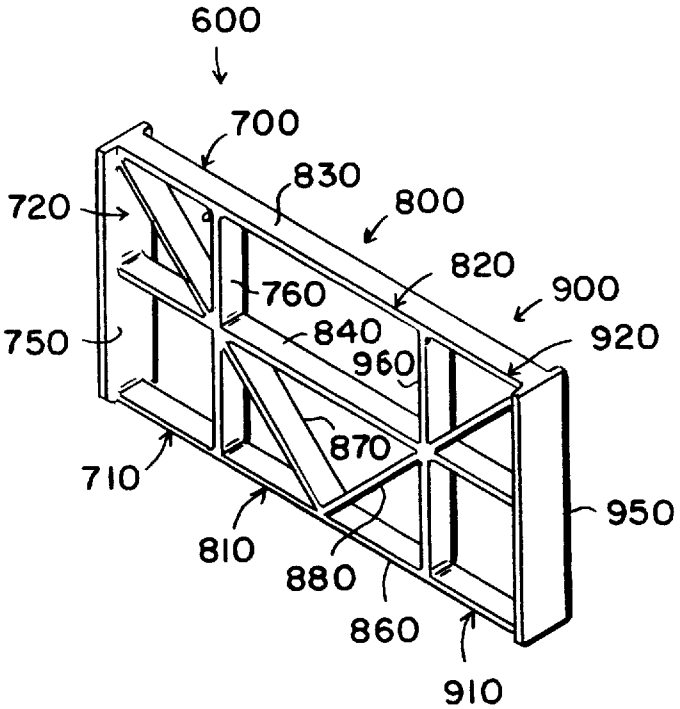
FIG. 6 is a perspective view of the concrete tie of FIG. 5.
Figure 13:
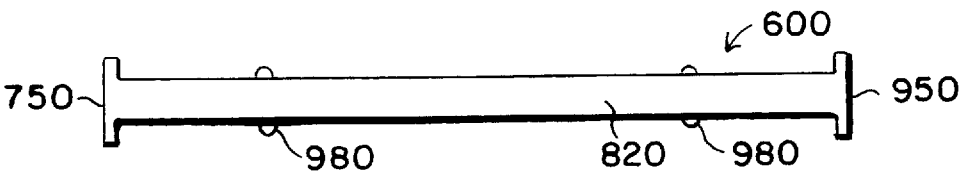
FIG. 13 is a top view of the tie of FIG. 5.
Figure 5:
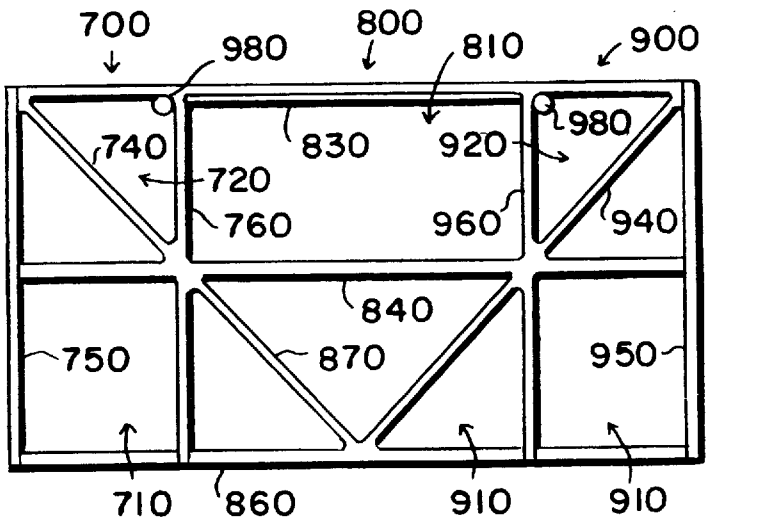
FIG. 5 is a plan view of an alternative form of the concrete tie for use adjacent the ends of a concrete form.
Figure 8:
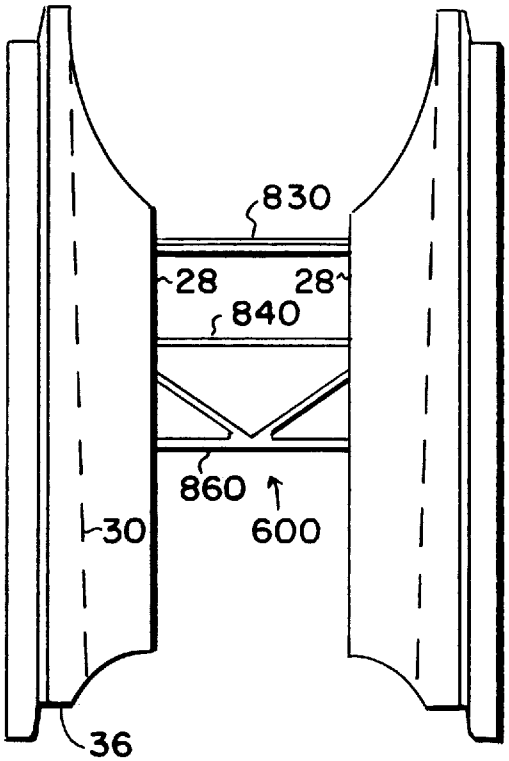
FIG. 8 is an end view of one end of the concrete form of FIG. 9.
Figure 7:
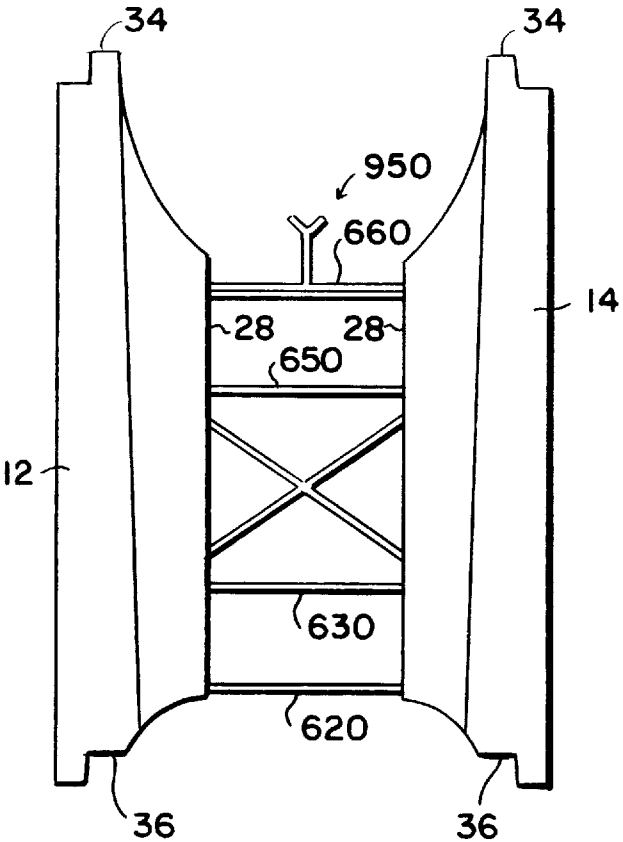
FIG. 7 is a section view taken along lines 7—7 in FIG. 9.

End ties 600 are as shown in FIGS. 5 and 6 and are approximately one-half the height of the primary tie 100. Each end tie 600 comprises first 700 and second 900 end trusses with an intermediate web 800. Each end truss 700, 900 comprises a first vertical strut 750, 950 with a second vertical strut 760, 960 laterally displaced therefrom. A pair of horizontal struts 830, 860 extend between the lower and upper ends of the end struts 750, 950 and intermediate vertical struts 760, 960. An intermediate horizontal strut 840 extends between the vertical struts. The struts, as above described, present the primary trusses 700, 800, 900. Each end truss 700, 900 further presents lower 710, 910 and upper 720, 920 trusses. The web 800 also has lower 810 and upper 820 truss sections.

A diagonal strut 740, 940 extends between the opposed corners of the upper end trusses 720, 920. Diagonal struts 870, 880 extend from the upper corners of the lower web truss 810 and towards the midpoint of the lower horizontal strut 860.

Figure 9:
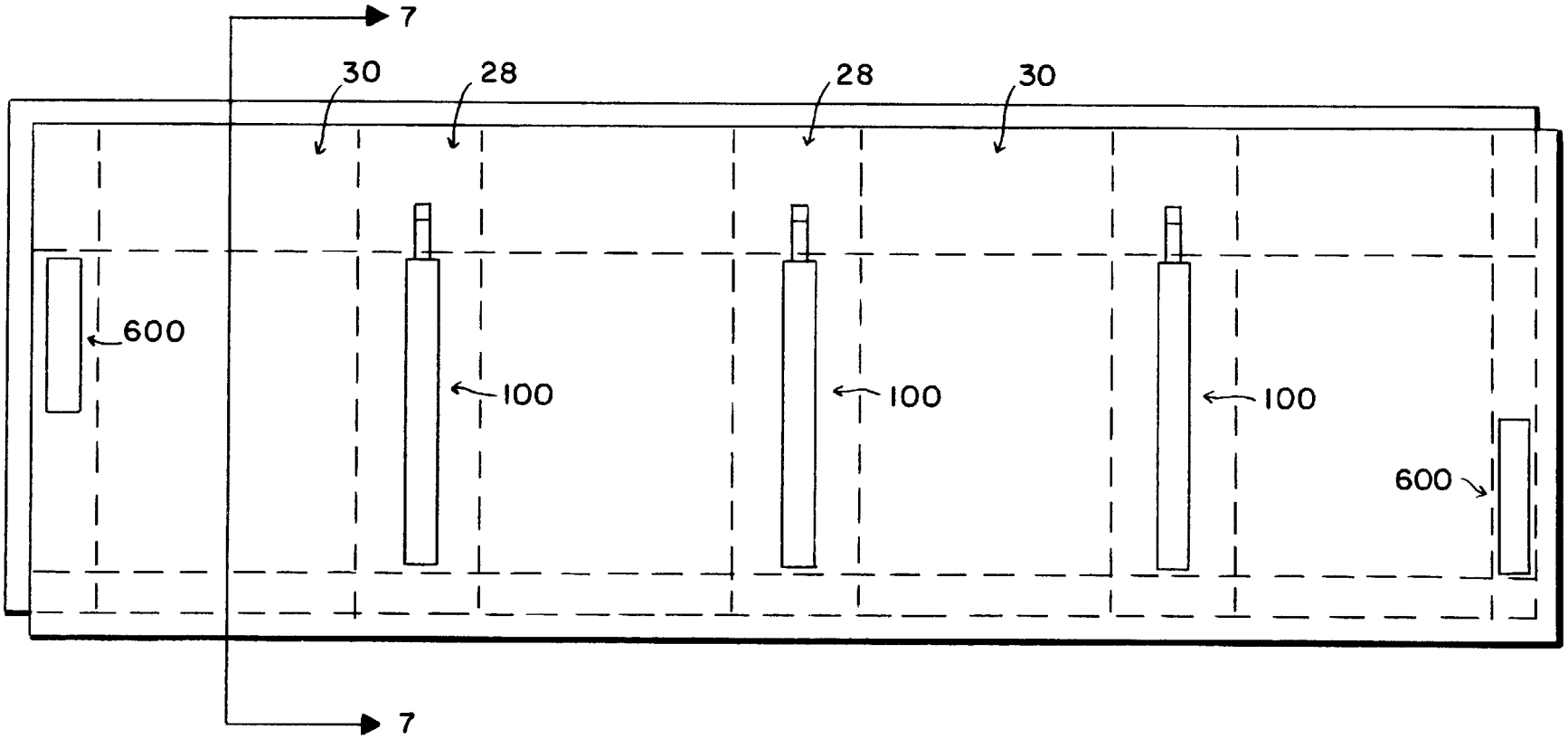
FIG. 9 is a side view of the concrete form with the phantom lines defining the various cavities and form ties therein.
Figure 10:
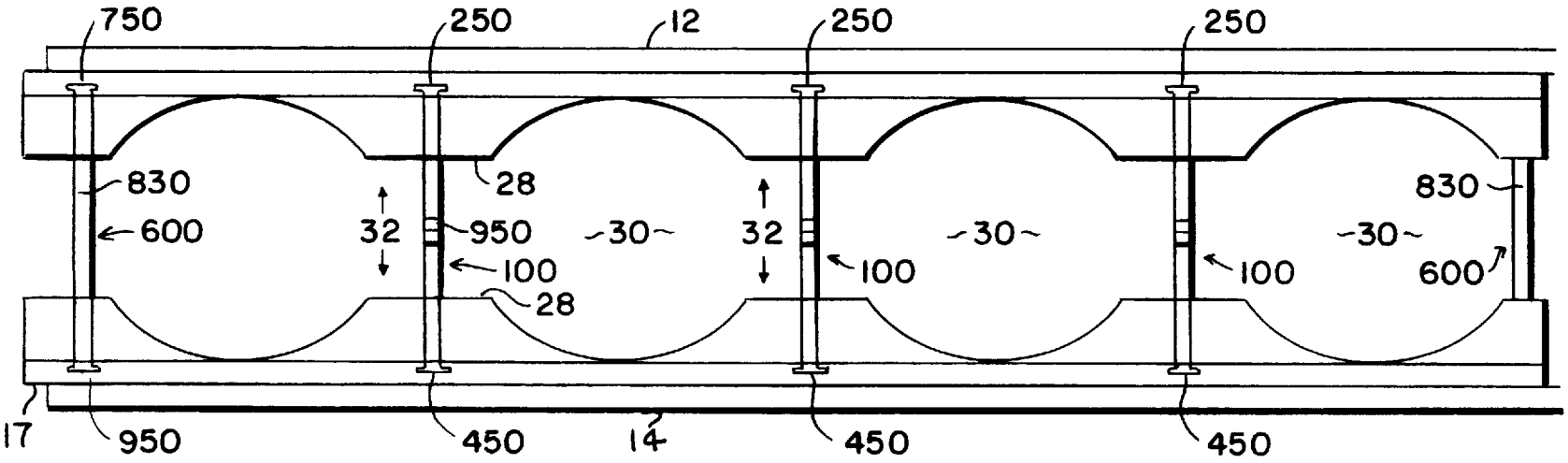
FIG. 10 is a top view of the concrete form of FIG. 9.
Figure 11:
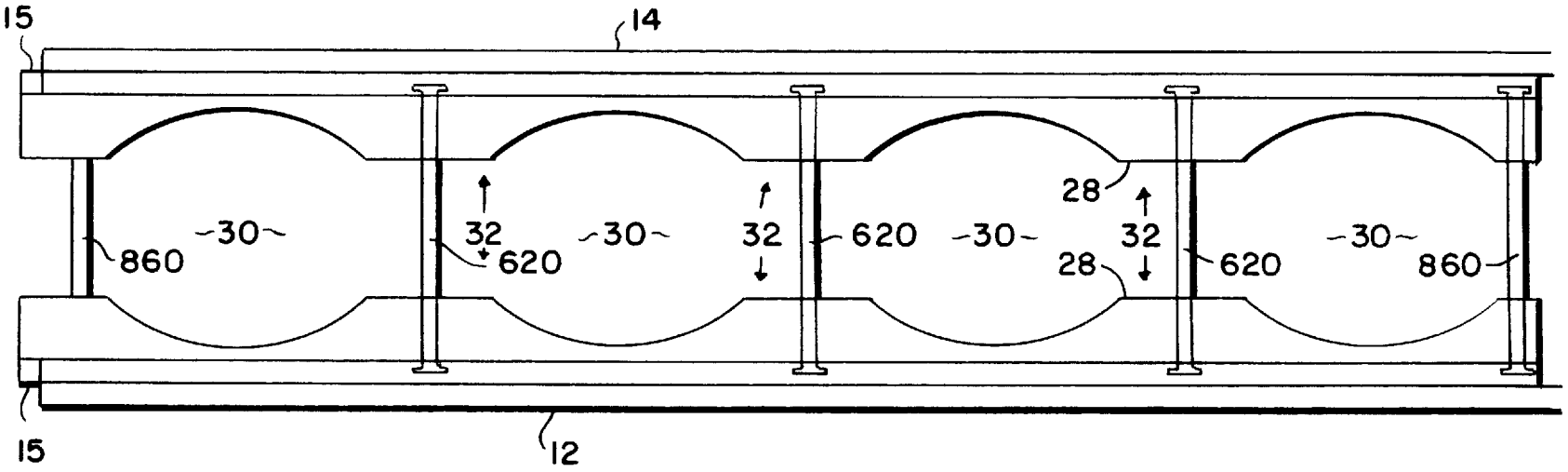
FIG. 11 is a bottom view of the forms of FIG. 9.

As shown in FIGS. 1 and 9 the top strut 830 of end tie 600 is aligned with the top strut 660 of a tie 100 at one end of the form 10. At the opposed end of the form the bottom strut 620 of tie 600 is aligned with the bottom strut 860 of a tie 100 to present a vertical offset therebetween. Upon a first form 10 being connected with a longitudinally adjacent second form, a pair of form ties 600 will be longitudinally adjacent but vertically offset from one another. These vertically offset ties 600 are utilized in lieu of ties 100 to preclude the restriction of concrete flow between longitudinally adjacent forms 10. Also, the end ties 600 found at the vertical joint formed by connected forms strengthens this vertical joint so as to diminish "blow out" therealong.

The primary and secondary rectangular trusses of the ties 100, 600, as above described, resist tension, compression, bending, twisting and lateral forces acting thereon during transport as well as during concrete pouring and curing.

Such trusses are further reinforced by the diagonal struts extending therethrough. These diagonal struts enhance the maintenance of the overall configuration of the tie, the primary 200, 300, 400 trusses and the secondary trusses therein. Moreover, the portions of the diagonal struts, as embedded in the form material, present additional bearing surfaces resistant to the various pressures presented by the poured concrete. Thus, the vertical, lateral and longitudinal forces acting on the form faces during transport and subsequent use are resisted so as to maintain the desired spatial relationships/modularities of the form sidewalls 12, 14.

The relatively larger width of the outside 250, 450 struts presents an enlarged bearing surface to the surrounding foam. This relationship not only resists twisting of the form 100 in the face of longitudinal stresses acting thereon but enhances the resistance against pressures resulting from the concrete poured between the form sidewalls 12, 14. Thus, longitudinal shifting of the sidewalls 12, 14 of the form 10 is particularly precluded. Such preclusion also contributes to the elimination of reduction in the width modularity during form use.

Tie 100 presents a seat 950 extending from the upper horizontal strut 660 for receiving a portion of horizontal rebar (not shown) therein. Upon rebar placement vertical rebar is extended through the respective cavities, offset from the centerline and tied to the horizontal rebar.

It is to be understood that while certain forms of this invention and dimensions have been illustrated and described, it is not limited thereto except insofar as such limitations are included in the following claims and allowable functional equivalents thereof.

Having thus described the invention, what is claimed as new and desired to be secured by Letters Patent is as follows:

1. In combination with first and second sidewalls of a concrete form, at least one form tie for maintaining a desired spatial relationship between first and second facing interior surfaces of the sidewalls of the concrete form, said tie comprising:

first and second end trusses with an intermediate web truss therebetween, each end truss embedded within a respective sidewall of the form comprising:

first and second laterally spaced-apart vertical struts, said second vertical strut having upper and lower ends and generally spanning the vertical extent of a facing interior surface of a respective sidewall with said upper end adjacent a top edge of said interior surface and said lower end adjacent a bottom of said interior surface, said first vertical strut having upper and lower ends and extending between a top and bottom edge of said respective sidewall;

a first pair of vertically spaced-apart horizontal struts extending between said first and second vertical struts to form a primary rectangular truss in combination with said vertical struts;

a second pair of vertically spaced-apart horizontal struts disposed between said struts of said first pair of horizontal struts and extending between said first and second vertical struts to form within said primary rectangular truss a pair of secondary upper and lower rectangular trusses with an intermediate truss therebetween;

a diagonal strut within said upper and lower trusses to provide rigidity thereto;

said web truss intermediate said first and second end trusses and extending between the facing interior surfaces of the first and second sidewalls of the form comprising:

at least a first pair of vertically spaced-apart horizontal struts extending between said second struts of each end truss to form at least one rectangular truss intermediate said first and second primary end trusses, said horizontal struts having a length generally corresponding to a desired spatial relationship between the first and second facing interior surfaces of the sidewalls of the form;

a second pair of vertically spaced-apart horizontal struts disposed between said struts of said first pair of horizontal web struts and extending between said second vertical struts to form a pair of secondary upper and lower rectangular trusses with an intermediate truss therebetween;

at least one diagonal strut within at least said intermediate truss to provide a rigidity thereto;

each end truss embedded within the respective sidewalls in a manner to extend said web truss between the interior surfaces of the facing sidewalls of the form, whereby to maintain the sidewalls in said desired spatial relationship.

2. The device as claimed in claim 1 wherein said second strut of each end truss is co-planar with the interior facing surface of each sidewall to indicate a desired lateral relationship between the interior surfaces of the form sidewalls.

3. The device as claimed in claim 1 wherein said first strut of each end truss is larger than said second strut of each end truss to anchor said end truss in the respective sidewall.

4. The device as claimed in claim 1 further comprising:

a seat projecting from a horizontal strut of said web, said seat adapted to support a rebar therein.

5. A form tie for maintaining a desired spatial relationship between first and second facing interior surfaces at opposed ends of first and second facing sidewalls of a concrete form, each form tie comprising:

first and second laterally spaced-apart end trusses with an intermediate web truss therebetween, each end truss adapted to be embedded within a respective sidewall at a sidewall end comprising:

first and second laterally spaced-apart vertical struts, each second vertical strut having a length of approximately one-half a height of a facing interior surface of a facing sidewall and adapted to vertically extend therealong, said first vertical strut being laterally displaced from said second vertical strut and adapted to vertically extend within said sidewall;

at least a pair of horizontal struts extending between said first and second vertical struts to form at least one rectangular truss in combination with said first and second vertical struts;

at least one strut diagonally extending between said first and second struts;

a web intermediate said first and second end trusses comprising:

at least a pair of horizontal struts extending between said adjacent second vertical struts of each end truss to form at least one rectangular truss intermediate said first and second end trusses and adapted to extend between said facing interior surfaces;

at least one strut diagonally extending through said at least one rectangular truss;

each end truss adapted to be embedded within the respective sidewall of the form with said first strut adapted to be embedded in said sidewall and said second strut adapted to be positioned adjacent an interior surface of each sidewall, said web extending between the facing interior surfaces of the sidewalls of the form at one end thereof, said tie at one end of said facing sidewalls adapted to be positioned in a vertically offset relationship relative to said tie at an opposed end of said facing sidewalls.

6. The device as claimed in claim 5 wherein the opposed ends of each sidewall have complementary mating elements for connecting first and second concrete forms in a longitudinally adjacent relationship wherein said form ties at the adjacent end of adjacent forms are adapted to be positioned vertically offset relative to each other.

7. The device as claimed in claim 5 wherein each end truss further comprises an intermediate horizontal strut extending between said first and second vertical struts, said intermediate strut forming upper and lower trusses within said at least one rectangular truss, said at least one diagonal strut extending through either said upper or lower truss.

8. The device as claimed in claim 7 wherein said web further comprises an intermediate horizontal strut extending between said vertical struts of each end truss, said intermediate web strut forming upper and lower trusses, said at least one diagonal strut extending through said upper or lower trusses of said web.

9. The device as claimed in claim 8 wherein said at least one diagonal strut comprises a pair of struts extending from a corner of said upper or lower web trusses to one of said pair of horizontal struts of said web.

10. A concrete form assembly comprising:

a pair of laterally spaced-apart side panels having first and second longitudinally spaced-apart ends and presenting facing interior surfaces having top and bottom edges and exterior surfaces laterally displaced from said interior surfaces;

at least one tie for maintaining a desired laterally spaced relationship between said interior surfaces of said laterally spaced-apart side panels, said at least one tie at a location intermediate said ends of said panels and comprising:

first and second end trusses with an intermediate web therebetween, each end truss adapted to be embedded in one of said panels and comprising:

first and second laterally spaced-apart vertical struts with said second strut having top and bottom ends adapted to generally vertically span said top and bottom edges of said facing interior surface of said panel, said first strut within said panel and laterally displaced from said second strut;

a first pair of vertically spaced-apart horizontal struts extending between said first strut and said second vertical strut to form a primary rectangular truss within said panel in combination with said vertical strut;

a second pair of vertically spaced-apart horizontal struts disposed between said struts of said first pair of horizontal struts and extending between said first and second vertical struts to form a pair of secondary upper and lower trusses with an intermediate truss therebetween;

a web intermediate said first and second end trusses and extending between said facing interior surfaces comprising:

at least a pair of horizontal struts extending between said top and bottom ends of said second struts of each end truss to form at least one rectangular truss intermediate said first and second primary end trusses;

a second pair of vertically spaced-apart horizontal struts disposed between said struts of said first pair of horizontal struts and extending between said vertical second struts to form a pair of secondary upper and lower rectangular trusses with an intermediate truss therebetween;

each end truss embedded within said respective panel in a manner to extend said web between said top and bottom edges of the interior surfaces of the form whereby to maintain the side panels in said laterally spaced apart relationship.

11. The device as claimed in claim 10 further comprising:

first and second end form ties for extension between facing interior surfaces of said side panels at the opposed first and second ends thereof, each end form tie comprising:

first and second laterally spaced-apart end trusses with an intermediate web truss therebetween, each end truss embedded within a respective side panel comprising:

first and second laterally spaced-apart vertical struts, each second vertical strut having a length of approximately one-half a height of an interior surface of a facing interior side panel surface and adapted to vertically extend therealong, said first vertical strut being laterally displaced from said second vertical strut;

at least a pair of horizontal struts extending between said first and second vertical struts to form at least one rectangular truss in combination with said first and second vertical struts;

at least one strut diagonally extending between said first and second struts;

a web intermediate said first and second end trusses comprising:

at least a pair of horizontal struts extending between said adjacent second vertical struts of each end truss to form at least one rectangular truss intermediate said first and second end trusses and adapted to extend between said interior surfaces at said opposed ends of said form;

at least one strut diagonally extending through said at least one rectangular truss;

each end truss of each one of said end form ties positioned within the respective side panel of the form at each one of said opposed ends thereof with said first strut embedded in said side panel and said second strut positioned adjacent an interior surface of each side panel, said web extending between the facing interior surfaces of the side panels of the form at an end thereof, whereby to maintain the side panels in place.

12. The device as claimed in claim 11 wherein said first end form tie at said first end of said side panels is positioned to extend between said facing interior surface at a vertically offset position relative to said second end form tie extending between said opposed surface at said second opposed end of said side panels.

13. The device as claimed in claim 12 wherein each side panel has complementary mating elements at said first and second opposed ends for connecting first and second concrete form assemblies in a longitudinally adjacent relationship wherein said end form tie of a first form assembly is at a vertically offset position relative to an end form tie of a second form assembly upon said connection, said offset of said adjacent end form ties adapted to enhance concrete flow between said connected first and second form assemblies.

* * * * *